US005568677A

United States Patent [19]

Tobin

[11] Patent Number: 5,568,677

[45] Date of Patent: Oct. 29, 1996

[54] ENVIRONMENTALLY SAFE AND ECONOMICAL BURIAL CASKET

[76] Inventor: Robert A. Tobin, 1842 Turk Hill Rd., Fairport, N.Y. 14450

[21] Appl. No.: 114,636

[22] Filed: Sep. 2, 1993

[51] Int. Cl.[6] ..... A61G 17/00

[52] U.S. Cl. ..... 27/17; 27/2; 27/14; 220/357

[58] Field of Search ..... 27/1, 2, 7, 11, 27/14, 19, 17; 52/128–133; 220/357, 358

[56] References Cited

U.S. PATENT DOCUMENTS

| | | | |
|---|---|---|---|
| 2,130,651 | 9/1938 | Phillips | 220/357 |
| 2,533,827 | 12/1950 | McEWan | 27/17 |
| 2,570,361 | 10/1951 | Mejia | 27/1 |
| 2,809,416 | 10/1957 | Vincius | 27/17 |
| 2,811,768 | 11/1957 | Axelson | 27/17 |
| 3,164,880 | 1/1965 | Hotchkiss | 27/17 |
| 3,435,494 | 1/1969 | Pothier . | |
| 3,581,452 | 6/1971 | Jalbert | 27/1 |
| 3,654,675 | 4/1972 | Peterson | 27/1 |
| 3,781,948 | 1/1974 | Pitt | 27/17 |
| 3,892,417 | 7/1975 | Clayton | 27/2 X |
| 4,154,031 | 5/1979 | Williamson | 27/35 |
| 4,315,353 | 2/1982 | Sorensen | 27/2 |
| 4,727,632 | 3/1988 | Yearsley . | |
| 4,759,104 | 7/1988 | Buerosse | 27/1 |
| 4,759,105 | 7/1988 | Buerosse | 27/1 |
| 4,879,789 | 11/1989 | Bak | 27/2 |
| 5,161,288 | 11/1992 | Chatman | 27/2 |
| 5,287,603 | 2/1994 | Schorman | 27/1 |

FOREIGN PATENT DOCUMENTS

| | | | |
|---|---|---|---|
| 2547609 | 12/1984 | France | 52/132 |

OTHER PUBLICATIONS

Going out in Style "People Magazine" Feb. 1993.
The Caskette Brochure.
Pet Caskette Brochure.

*Primary Examiner*—Carl D. Friedman
*Assistant Examiner*—Beth Aubrey

[57] ABSTRACT

A burial casket so configured of a non-biodegradable, corrosion-proof material to obtain the required mechanical strength with a minimum of material. The self-sealing gasket made of resilient material helps hold the cover on the casket and compresses at right angles to the direction the cover is put on the casket. An air valve allows the cover to be put on or taken off easily, the casket tested for air tightness, oxygen to be purged from the casket, and an inert gas to be pressurized to slow decomposition of the cadaver in the casket. A relief valve-filter assembly relieves and deodorizes any excessive pressure caused by decompositions gases.

9 Claims, 2 Drawing Sheets

ENVIRONMENTALLY SAFE AND ECONOMICAL BURIAL CASKET

BACKGROUND OF THE INVENTION

1. Field of the Invention

The subject invention generally pertains to burial caskets, and more specifically, ways to make them environmentally safer and cost effective with novel improvements.

2. Description of Related Art

Burial caskets evolved from a wooden box with a flat cover. A vast majority of the useable volume in today's burial caskets is still in the bottom part. Some areas, by tradition use a "half couch" casket with a two-part cover, which make any internal volume in the cover unusable. The covers are attached to the casket's bottoms with hinges.

As a result, the cadaver is usually raised for viewing, and then lowered in order to close the cover before the burial. This situation leads to the invention of the adjustable bed, U.S. Pat. No. 4,993,129, which represents an added cost. The threaded hole used to raise and lower the bed, sometimes tears the decorative lining when they get caught in it. If a cadaver is going to be viewed for a day or two, most funeral homes require it to be embalmed to slow down the deterioration and reduce the accompanying odor. This process replaces the normal bodily fluids with formaldehyde, a very dangerous and toxic chemical. The procedure is considered intrusive and tolerated only to permit one or two days of funeral home viewing.

Most of the caskets made in the United States are made of steel or wood. These materials in damp condition deteriorate. Many variables including the thickness of the material used, type of finish, amount of moisture present, chemicals present, galvanic conditions, etc., will actually determine how long before the structural integrity of the casket is compromised. Bodily and embalming fluids supply moisture and chemicals to the casket internally.

Other more corrosion-resistant metals are used such as copper/bronze and stainless steel, but sparingly because of the high cost. Even these metals deteriorate, especially when the conditions for galvanic corrosion are present. Some steel caskets use anodes to delay the galvanic corrosion. Fiberglass is used in some caskets. While it is resistant to corrosion, its relatively high cost makes it too expensive to make it thick enough to be structurally sound.

When caskets structurally collapse, the dirt above the casket caves in and the cemeteries had to fill in the hole with dirt. To alleviate this problem, many cemeteries now require concrete vaults. Decayed caskets and porous concrete vaults still could allow bodily and embalming fluids to contaminate the surrounding ground water. More expensive vaults with plastic and metal linings prevent this. If sometime in the future, cemeteries are dedicated to other uses, or more stringent environmental laws are passed, it will be costly to remove and dispose of or relocate these heavy concrete vaults and the caskets contained therein.

Metal caskets are made by joining pieces of metal together. Wood caskets are made by joining pieces of wood together. The seams are not always water and air tight, or remain so if they were. U.S. Pat. No. 4,949,439 was granted for a drip pan that would catch in the casket any leaking bodily or embalming fluids when it was in the funeral home, church, hearse, or mausoleum. Once buried this no longer remains an aesthetic or immediate health problem, but still may be a long term environmental one.

Some metal caskets come with a gasket. At one time they were sold as "air and water tight." Caskets that were not "air and water tight" in their construction, could not benefit from such a gasket. Even if "air and water tight," corrosion could eventually "eat" a hole through the casket and make the use of any gasket senseless. Odors and leakages are a problem in mausoleums and U.S. Pat. No. 4,727,632 was granted for enclosing and protecting entombment caskets while incorporating a pressure relief valve. U.S. Pat. No. 3,435,494 also employs a pressure relief valve.

Several types of locking devices are used to secure the casket cover shut during the transportation and burial. One very simple external lock is inexpensive. Another patented locking system, U.S. Pat. 5,060,993, is internal and more expensive. These lock at several points on the perimeter of the closure. They are made of metal and therefore they can corrode.

Wood caskets present a problem in rural areas. Rural cemeteries aren't always able to dig graves in the winter, so they put the caskets in cold storage until spring. This causes the wood to crack which is an early start on the final deterioration. When dense hardwood is used, caskets can weigh as much as two hundred pounds which can be a problem for the pall bearers especially when, in addition, the cadaver exceeds two hundred pounds.

SUMMARY OF THE INVENTION

To avoid the limitations and problems with the present embodiments of the burial caskets, it is an object of the subject invention to make a verifiable "air and water tight," hermetically sealed burial casket economically.

Another object is to make a burial casket that is structurally strong and durable enough to perform the functions of both the normal casket and burial vault.

Another object is to make a burial casket that was proportioned so it would not require an adjustable bed.

Another object is to make a burial casket that would not require a drip pan by using seamless (i.e., unitary cover and a unitary container), non-biodegradable, corrosion-proof material in this construction.

Another feature would be an air valve in the casket that would facilitate testing of the seal, removing oxygen, and introducing inert gas to slow the decomposition of the cadaver, and pressurize the casket with inert gas to slow oxygen from leaking back into the casket before it's buried.

Another object is to make embalming optional by using a transparent cover and inert gas to preserve the cadaver for viewing.

Another feature is a self-sealing gasket that could be bonded to both the cover and the container in order to make the closure hermetically sealed and permanent.

Another feature would be the configuration of the casket so when it was closed, opposite parts would put substantially horizontal pressure on the self-sealing gasket without using the weight of the parts or any kind of mechanical clamps.

Another feature would provide the half couch appearance with an internal "half cover" that was independent of the integrity and simplicity of the self-sealing gasket between the cover and the container of the casket.

Another feature is the detached cover that centers on the container and gasket assembly in order to provide equal and opposite forces on diametrically opposed points on the assembled casket.

Another feature would be a check valve and filter that would relieve and filter any excessive decomposition gases, before the casket is buried, and especially in mausoleums where the external filter could be changed as required.

These and other objects of the invention are provided by a non-biodegradable, corrosion-proof material used in a novel configuration of the cover and container of the casket. A self-sealing gasket provides an "air and water tight" seal for the casket. Air valves allows gases to leave or enter the casket at appropriate times, facilitating putting on or taking off the cover, testing the seal, slowing the decomposition of the cadaver, and relieving excessive pressure when required.

DESCRIPTION OF THE PREFERRED EMBODIMENT

Figure 1:
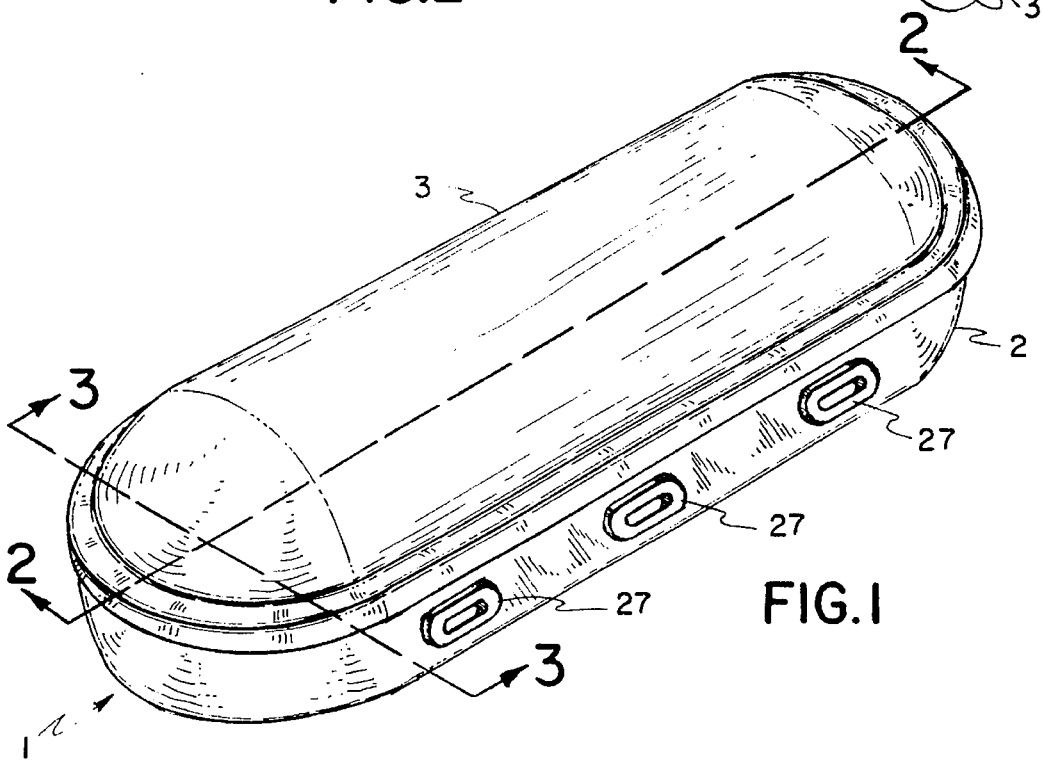
FIG. 1 illustrates an assembled casket.

Referring to FIG. 1, the casket 1 consists of a container 2 and a cover 3. The location of the sectional views 2—2 and 3—3 are shown. A multiplicity of handle 27 are used to move the casket.

Figure 2:
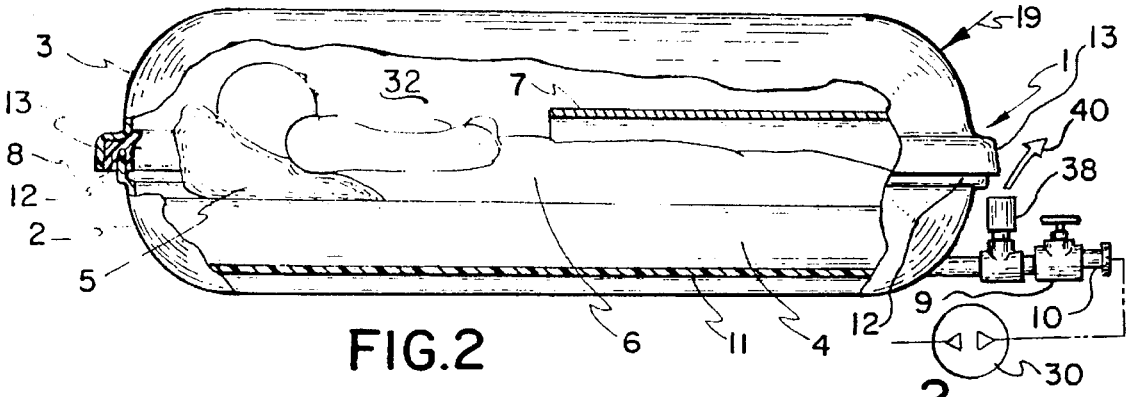
FIG. 2 illustrates a section view of the side of the assembled casket.

Referring to FIG. 2, sectional view 2—2, the container 2 and the cover 3 of the casket 1 are made with a non-biodegradable, corrosio- proof material that can be fabricated by various processes including injection molding and thermoforming. In one embodiment of the invention, casket 1 is made of a polymeric material. Examples of polymeric materials include but are not limited to polycarbonate and acrylic. The mattress 4 and pillow 5 allow the cadaver 6 to be arranged for viewing and viewed in the container 2 when the cover 3 is off the casket 1. The cover 3 can then be put on the container 2 and self-sealing gasket 8 assembly with the cadaver 6 still in the same viewing position. The container 2 and the cover 3 each contain substantially one-half of the volume of casket 1.

The air valve 9 allows gases to enter and leave the sealed casket 1 at appropriate times. In one embodiment of the invention, valve 9 is a conventional manually manipulable control valve. The term "manually manipulable valve" used herein refers to user controlled as opposed to environmentally controlled. A few examples of a manually manipulable valve would include, but not be limited to, ball valves, globe valves, and electrically actuated solenoid valves. In contrast, an example of an environmentally controlled valve would include a pressure relief valve. The valve cap 10 seals and protects the air valve 9 when it is not in use.

Figure 4A:
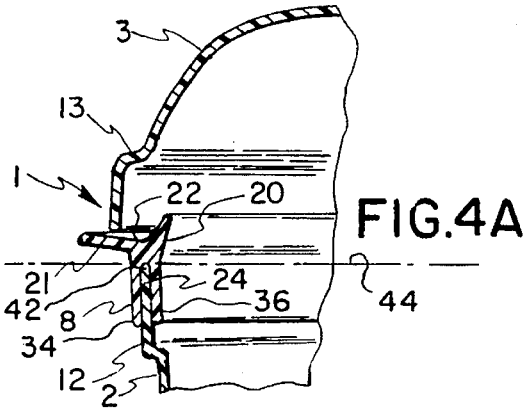
FIGS. 4A, 4B and 4C illustrate how the self-sealing gasket functions as the cover is put on the container-gasket assembly. The motions of the moving from an open position to a closed position are shown.

The self-sealing gasket 8 is bonded to container 2. As cover 3 is put on container 2, the self-sealing gasket 8, seals the casket 1 and forces air out an open air valve 9 so the internal and external pressure remains equal. Air valve 9 is then closed. Any attempt to lift cover 3 will decrease the internal air pressure and the higher external atmospheric pressure 19, will help hold cover 3 on container 2. Referring to FIG. 4A, gasket 8 includes a first lip 34, a second lip 36, a third lip (referred to as tongue 21), and a fourth lip (referred to as tongue 20).

To remove cover 3 from the container 2, allow air to enter casket 1 through air valve 9 as cover 3 is being lifted to equalize the internal and external pressures, so only the friction between the cover 3 and the self-sealing gasket 8 has to be overcome.

To test the air tightness of the casket 1, reduce the pressure in casket 1 by removing air through air valve 9, and see how long a difference in pressure is maintained with the air valve 9 closed. An air pump 30, schematically illustrated in FIG. 2, provides a means of pressurizing or evacuating the interior 32 of casket 1.

To slow the decomposition of cadaver 6, remove the oxygen from casket 1 and replace it with an inert gas. The inert gas can be pressurized to something greater than atmospheric pressure to prevent oxygen from slowly leaking back into casket 1 due to the permeability of the construction material and microscopic leaks until the casket 1 is buried, after which oxygen is not available.

The extra internal pressure will also counteract the compressive force 17 of the dirt 18, and push self-sealing gasket 8 against container 2 and cover 3 for a better seal. If the internal pressure exceeds a predetermined upper limit, relief valve filter assembly 38 will vent the excess pressure to atmosphere as indicated by arrow 40.

The half cover 7 is optional and is independent of cover 3 and self-sealing gasket 8. It provides the half couch appearance with the cover 3 and the self-sealing gasket 8 being unchanged and uncomplicated by this feature.

Another embodiment would have cover 3 made from a transparent material in order to allow viewing of an unembalmed cadaver 6 in a hermetically sealed casket 1. An inert gas will slow any deterioration of the cadaver 6 and the sealed casket 1 will contain any undesirable odors.

Figure 3:
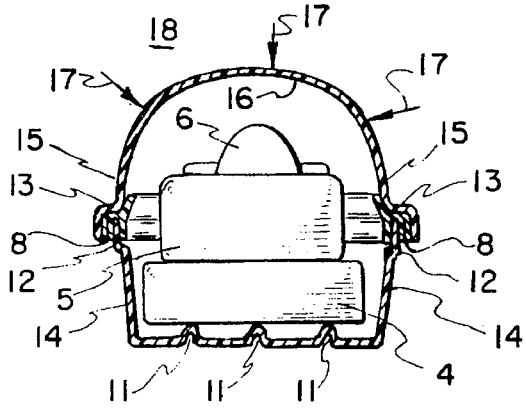
FIG. 3 illustrates a cross-sectional view of the assembled casket.

Referring to FIG. 3, section view 3—3, re-enforcing ribs 11 are offered the length of container 2 to strengthen it. The horizontal lip 12 in the container 2 and lip 13 in the cover 3 limit the horizontal movement of point 14 in the container 2 and point 15 in the cover 3 respectively. Points 14 and 15 are typical of any points around the perimeter of their respective parts but the maximum deflection will tend to occur around the mid-sections of the container 2 and cover 3.

The cross-sectional arch 16 of the cover 3 is used to strengthen the cover 3 against the compressive force 17 of the dirt 18. The reinforcing ribs 11, the lips 12 and 13, and the arch 16 are used to maximize the strength of the casket 1 while minimizing the quantity and physical specifications of the material required to meet the design requirements.

Referring to FIG. 4A, the cover 3 is centered above the container 2 self-sealing gasket 8 assembly. Tongue 21 (third lip) extends beyond the edge of cover 3 on all sides. Container 2 includes a peripheral edge 42 that lies substantially in a plane 44. It should be noted that peripheral edge 42 may not lie perfectly flat in plane 44 due to warpage commonly occurring during processing of relatively large plastic parts such as container 2.

Figure 4B:
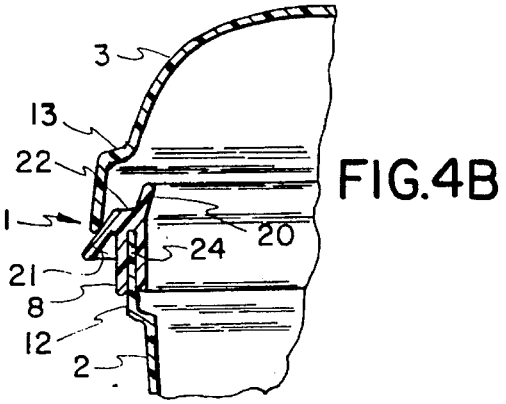

Referring to FIG. 4B, as cover 3 is lowered, it contacts tongue 21 and deflects it downward.

Figure 4C:
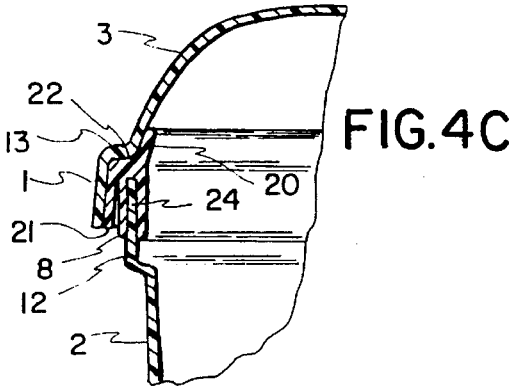

Referring to FIG. 4C, as cover 3 bottoms out against self-sealing gasket 8, tongue 21 makes maximum contact with cover 3 to insure an air tight seal and it also exerts a uniform substantially horizontal force against cover 3 around this perimeter.

Figure 5A:
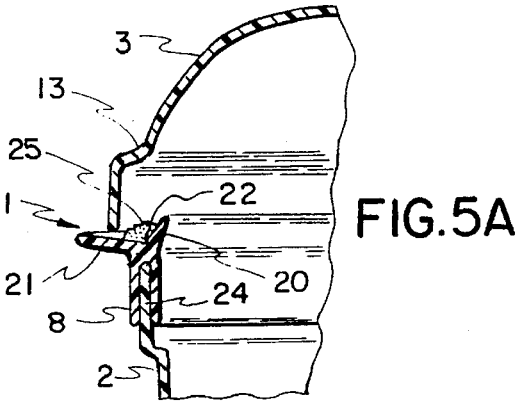
FIGS. 5A, 5B and 5C illustrate how the self-sealing gasket can automatically apply a bonding agent to that applicable part of the cover as it is put on the container-gasket assembly.

Referring to FIG. 5A, the cover 3 is positioned over the container 2 with the self sealing gasket 8 bonded to edge 24. Tongues 20 and 21 form a trough 22 in their free state where adhesive bonding agent 25 can be placed.

Figure 5B:
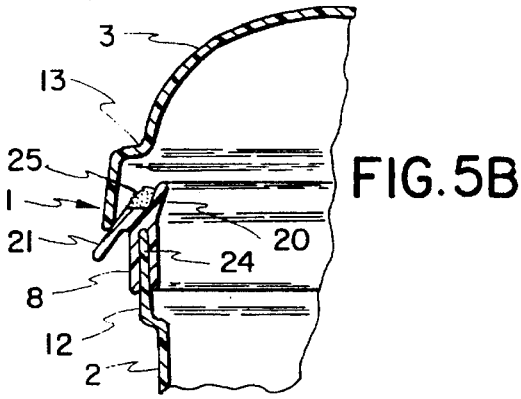

Referring to FIG. 5B, as cover 3 is lowered tongue 21 is deformed and wipes the overflow of bonding agent 25 against the adjacent part of cover 3.

Figure 5C:
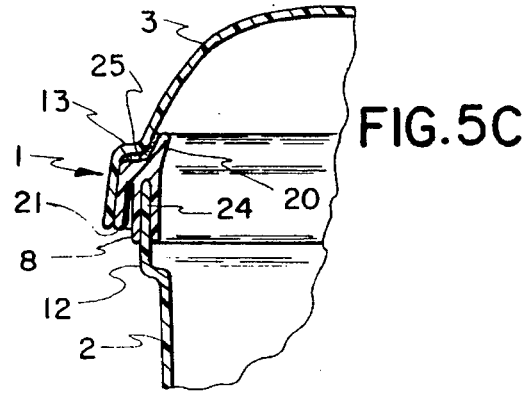

Referring to FIG. 5C, as the cover 3 bottoms out against gasket 8, any remaining bonding agent 25 is forced between the tongue 20 (fourth lip) and the adjacent part of cover 3. The substantially horizontal and vertical adjacent surfaces of cover 3 are then bonded to the self-sealing gasket 8, providing a permanent hermetic seal.

Figure 6:
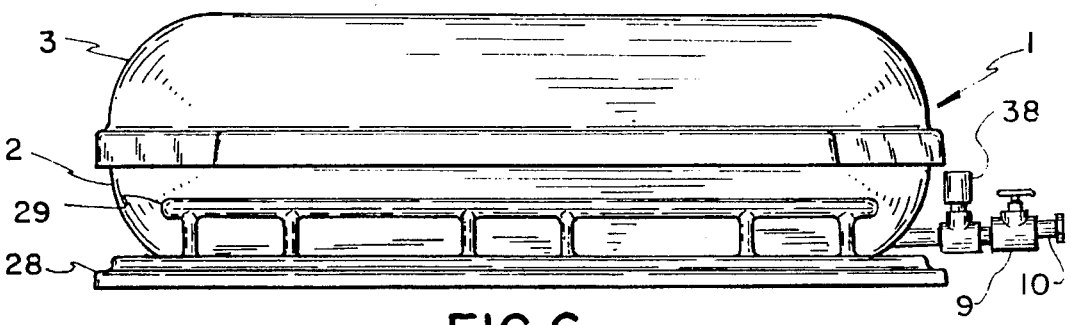
FIG. 6 illustrates the casket with a base.

Referring to FIG. 6, base 28 is attached to casket 1 to give it more stability when it is placed on a substantially flat surface, and to give the casket 1 a more traditional appearance.

Handrail 29 is provided as an alternative method of lifting. Air valve 9 and valve cap 10 are also shown.

It should be appreciated by those skilled in the art that valves 9 and 38 could be incorporated into a single assembly and still fall well within the scope of the invention.

Although the invention is described with respect to a preferred embodiment, the scope of the invention is to be determined by reference to the claims which follow.

I claim:

1. A Casket for a cadaver, said casket having an open position and a closed position, said casket having an interior that is adapted to be hermetically sealed from the exterior of said casket, said casket having parts and components fabricated from a polymer in order to eliminate or minimize the degradation of said casket due to corrosion and/or rotting, said parts and said components being fabricated by various manufacturing methods including but not limited to injection molding, extruding and vacuum forming, said casket having a configuration of a pressure vessel in order to withstand substantially elevated internal and external pressure while maintaining it's original form and structural integrity, said casket being able to be used for transporting, viewing embalmed, viewing unembalmed, cremating, burying in a vault, burying without a vault and entombing in a mausoleum, cadavers with only minor modifications to said casket, said casket being substantially strong enough structurally to be interred without a burial vault, said casket providing substantial structural strength while maintaining an aesthetically pleasing traditional appearance, said casket comprising;

a seamless unitary polymeric container adapted to hold said cadaver, said container having combinations of structural configurations including rounded ends, curved sides, a flange substantially at right angle to the adjacent part of said container around substantially the entire periphery of the opening and a substantially planar bottom reinforced with ribs, to provide stability when said casket is resting on a substantially flat surface, that would allow said casket when assembled to withstand substantial deformation due to internal gas pressure and to withstand substantial deformation due to external pressure of the burial dirt with the additional help of said internal gas pressure thus requiring a minimal amount of said polymer in said container;

a seamless unitary polymeric cover adapted to fit on said container to place said casket in said closed position with said cover substantially spanning said container to encompass substantially all of said interior of said casket, said cover having combinations of structural configurations including an elongated dome and a flange at substantially right angles to the adjacent part of said cover around substantially all of the entire periphery of the opening;

a gasket that is continuous of a substantially low durometer, resilient polymer that can be bonded to said container around its' entire periphery and having a substantially outwardly and upwardly extended lip that would start to seal said casket as said cover started to be lowered on said container-gasket assembly, said gasket being located between the overlapping parts of said cover and said container so any pressure, internal and external, compresses said gasket, said cover centering itself on said container-gasket assembly, said lip being compressed at a substantially right angle to the direction of said cover as it was being put on said container-gasket assembly and the substantially increased friction between said gasket and said cover would hold said cover on said container-gasket assembly.

2. The casket of claim 1, further comprising a control valve being manually manipulable to selectively vent and hermetically seal said interior of said casket relative to said exterior for the purposes of putting on said cover by allowing air that would be compressed to escape, holding on said cover by preventing air from entering said casket to equalize said interior and said exterior pressure as said cover was being lifted, removing said cover by allowing air to enter said casket as said cover was being removed, testing hermetic seal by removing air for specified time to see if said hermetic seal leaked, and slowing said decomposition process by replacing said internal air with an inert gas.

3. The casket of claim 1, further comprising a relief valve controlled by pressure that would maintain a predetermined internal gas pressure substantially higher than said external pressure and relieve all said internal pressure exceeding said predetermined amount caused by said decomposition process, temperature changes, altitude changes and any other cause, said relief valve being mounted on the outside of said casket so it can be changed periodically or as needed without the unpleasant task of opening said casket when said casket was entombed in a mausoleum or was otherwise available in an area where odors were not desirable.

4. The casket of claim 2, further comprising a relief valve controlled by pressure that would maintain an internal gas pressure substantially higher than said external pressure.

5. The casket of claim 1, further comprising said container and said cover fabricated from cellulose acetate butyrate or equivalent that the environmental protection agency recommends burning as one of the desirable methods of disposal so the same said casket could be used for transporting, viewing and cremating said cadaver.

6. The casket of claim 4, further compromising said gasket with a trough formed by two lips having substantially upwardly open orientation that will permit a substantially low viscosity bonding agent introduced at one or more places along said trough to automatically flow the complete length of said gasket when said container-gasket assembly is substantially level, and said bonding agent would be automatically applied (squeegeed) against the adjacent part of said cover as said cover was put on said container-gasket assembly.

7. The casket of claim 6, further comprising a cover fabricated from a transparent polymer that would allow viewing of said cadaver after said cover was hermetically sealed and permanently bonded to said gasket, said control valve then being used to evacuate substantially all the oxygen from said hermetically sealed casket and then filled with an inert gas to temporarily slow the decomposition of said cadaver that had not been embalmed.

8. The casket of claim 7, further comprising a filter containing activated charcoal to deodorize any gases emanating from said casket through said relief valve during the viewing, other funeral services, and in a mausoleum.

9. The casket of claim 1, further comprising said cover and said container fabricated with airtight seams.

* * * * *